US007334525B2

(12) United States Patent
Jeter et al.

(10) Patent No.: US 7,334,525 B2
(45) Date of Patent: Feb. 26, 2008

(54) MODULAR GUIDEWAY FOR A MAGNETIC LEVITATION VEHICLE AND METHOD FOR MANUFACTURING A GUIDEWAY MODULE

(75) Inventors: Philip L. Jeter, San Diego, CA (US); Mandyam C. Venkatesh, Del Mar, CA (US)

(73) Assignee: General Atomics, San Diego, CA (US)

( * ) Notice: Subject to any disclaimer, the term of this patent is extended or adjusted under 35 U.S.C. 154(b) by 0 days.

(21) Appl. No.: 10/966,640

(22) Filed: Oct. 15, 2004

(65) Prior Publication Data

US 2006/0081150 A1 Apr. 20, 2006

(51) Int. Cl.
*B61B 12/04* (2006.01)

(52) U.S. Cl. ..... 104/124

(58) Field of Classification Search ..... 104/124, 104/125, 118, 281, 282, 283
See application file for complete search history.

(56) References Cited

U.S. PATENT DOCUMENTS

| | | | | |
|---|---|---|---|---|
| 5,253,592 | A | 10/1993 | Coffey | |
| 5,431,109 | A * | 7/1995 | Berdut | 104/283 |
| 5,649,489 | A | 7/1997 | Powell et al. | |
| 5,722,326 | A | 3/1998 | Post | |
| 5,809,897 | A | 9/1998 | Powell et al. | |
| 6,044,770 | A * | 4/2000 | Davey et al. | 104/282 |
| 6,085,663 | A | 7/2000 | Powell et al. | |
| 6,152,045 | A | 11/2000 | Powell et al. | |
| 6,510,799 | B2 | 1/2003 | Lamb et al. | |
| 6,564,516 | B1 * | 5/2003 | Svensson | 52/174 |
| 6,684,793 | B2 * | 2/2004 | Dutoit | 104/124 |
| 6,782,832 | B2 * | 8/2004 | Reichel et al. | 104/124 |
| 6,827,022 | B2 | 12/2004 | van den Bergh et al. | |
| 6,889,616 | B1 * | 5/2005 | Heddrich et al. | 104/292 |
| 2003/0121151 | A1 * | 7/2003 | Reichel et al. | 29/897 |

* cited by examiner

*Primary Examiner*—S. Joseph Morano
*Assistant Examiner*—Robert J. McCarry, Jr.
(74) *Attorney, Agent, or Firm*—Nydegger & Associates

(57) ABSTRACT

A MAGLEV guideway module which can be supported by vertical columns to create a section of an elevated MAGLEV guideway is disclosed. The module includes a deck and an elongated box beam that are form cast together in a unitary monolithic construction and made of lightweight, steel reinforced concrete. Functionally, a plurality of modules cooperate to form an elevated levitation track that supports the operational electromagnetic guideway components and is designed to support the weight of a MAGLEV vehicle. For the module, the beam can be an elongated, hollow beam, such as a box beam, which is made of a molded, pre-stressed concrete. A molded-concrete transverse deck is integrally formed on the hollow beam. The deck includes first and second cantilevers that each extend from the beam in opposite directions. Together, the cantilevers and beam establish a substantially flat deck surface over which a MAGLEV vehicle can travel.

8 Claims, 5 Drawing Sheets

MODULAR GUIDEWAY FOR A MAGNETIC LEVITATION VEHICLE AND METHOD FOR MANUFACTURING A GUIDEWAY MODULE

FIELD OF THE INVENTION

The present invention pertains generally to an elevated guideway for a magnetically levitated (MAGLEV) vehicle. More particularly, the present invention pertains to a hybrid MAGLEV guideway module that can be supported by vertical columns to construct an elevated MAGLEV guideway. The present invention is particularly, but not exclusively, useful as a MAGLEV guideway module for use in a MAGLEV vehicle system which uses a linear synchronous motor (LSM) and an electro-dynamic system (EDS) for propulsion, levitation and lateral stability.

BACKGROUND OF THE INVENTION

Magnetic levitation systems, often called MAGLEV systems, typically take advantage of an electromagnetic interaction between components that are mounted on a vehicle, and components that are mounted on a stationary guideway. The consequence of this interaction is to levitate the vehicle over the guideway. Because the vehicle does not physically contact the guideway during its travel over the guideway, energy losses associated with contact friction are greatly reduced.

One particular system that utilizes the electromagnetic interaction between guideway-mounted components and vehicle-mounted components is disclosed in co-pending, co-owned U.S. patent application Ser. No. 10/330,733 which was filed on Dec. 27, 2002 and is titled "Magnetic Levitation and Propulsion System." U.S. patent application Ser. No. 10/330,733 (hereinafter the '733 application) is hereby incorporated by reference in its entirety herein. As disclosed in the '733 application, a system for levitating and propelling a vehicle along a stationary guideway includes a linear synchronous motor (LSM) having a component mounted on the vehicle (e.g. a linear array of permanent magnets) and a component mounted on the guideway (e.g. a polyphase winding on an iron core). In combination, these LSM components interact with each other to generate electromagnetic forces for two purposes. For one, the forces act to levitate the vehicle. For another, they act to propel the vehicle along the guideway. It happens that the strength of these LSM forces are strongly dependent on the size of the LSM gap (i.e. the distance between the vehicle-mounted LSM component and the guideway-mounted LSM component).

As further disclosed in the '733 application, the gap between LSM components can be maintained by an electrodynamic system (EDS) having a component that is mounted on the vehicle (e.g. a magnet array), and a component that is mounted on the guideway (e.g. a conductive sheet which is also sometimes called a Litz track). Specifically, the EDS generates electromagnetic forces during movement of the vehicle relative to the guideway that react with the levitation forces created by the LSM. In particular, the forces generated by the EDS maintain the LSM gap within a predetermined operational range. Maintenance of the LSM gap then stabilizes the LSM, and allows the LSM to operate efficiently within a pre-selected range of vehicle speeds.

As implied above, the guideway is an important part of the MAGLEV system. Typically, it is desirable to use a modular guideway design to facilitate guideway construction and simplify the delivery and assembly of the guideway. Functionally, all portions of the guideway must be capable of supporting the weight of the MAGLEV vehicle under all operational conditions. For example, in addition to normal operation, the guideway must also support the MAGLEV vehicle during a power outage or system failure. Further, for applications in high-density urban areas, it is often desirable to elevate the guideway. For these applications, it is desirable that elevated portions of the guideway be lightweight in order to reduce the size and cost of the guideway supporting structures. Moreover, in frigid climates, large guideway structures can cast relatively long shadows which can cause undesirable ice buildups on adjacent roads and roofs. Thus, for some MAGLEV system applications, the size, profile and weight of a guideway structure are all important design considerations.

Other factors that can be important in designing a MAGLEV guideway are the dimensional tolerances of the guideway components and the dimensional stability of the guideway. As indicated above, it is desirable to maintain the gap(s) between vehicle-mounted, and guideway-mounted LSM components within a pre-selected operational range. This, in turn, dictates that relatively tight tolerances be held with regard to the position of guideway-mounted LSM and EDS components and that the modular guideway components fit together closely. Moreover, the specified guideway dimensions must be stable over the life of the guideway and these dimensions must be maintained under typical MAGLEV system loading conditions. More specifically, guideway structures typically require one or more substantially flat surfaces that extend uniformly along the length of the guideway. Applications of these flat guideway surfaces include, but are not limited to, a landing surface for receiving the station/emergency wheels of a MAGLEV vehicle during a vehicle descent, and a structure on which LSM and EDS components can be mounted.

In light of the above, it is an object of the present invention to provide relatively light-weight guideway modules for an elevated MAGLEV guideway and methods for their manufacture. It is another object of the present invention to provide lightweight MAGLEV guideway components that are manufactured to close dimensional tolerances, and that maintain their structural integrity under typical MAGLEV system loading conditions. Yet another object of the present invention is to provide MAGLEV guideway components and methods for their manufacture which are easy to use, relatively simple to implement, and comparatively cost effective.

SUMMARY OF THE INVENTION

The present invention is directed to a MAGLEV guideway module that can be supported by vertical columns to create a section of an elevated MAGLEV guideway. Each guideway module includes an elongated beam that is made of lightweight, pre-stressed concrete. Functionally, the guideway modules are integrated to form an elevated levitation track that supports the operational electromagnetic guideway components and the weight of a MAGLEV vehicle.

In greater structural detail, each guideway module includes an elongated beam, such as a box beam, which has a first end and a second end. Also, each guideway module defines a longitudinal axis that extends between its first and second ends in the direction of elongation. In use, the first end is attached to a vertical column and is mated with the second end of an adjacent guideway module. For each guideway module, a portion (e.g. a lower portion) or all of the beam is made of a molded, pre-stressed concrete. Specifically, each beam is typically pre-stressed in a direction that is substantially parallel to the beam's longitudinal axis.

In a first embodiment of the invention, each module includes a concrete transverse deck that is monolithically cast with the box beam. In detail, the transverse deck includes first and second cantilevers that each extend from the beam in opposite directions, with the first cantilever extending to a first deck edge and the second cantilever extending to a second deck edge. Together, the cantilevers and the beam establish a substantially flat deck surface that runs from the first end to the second end of the module, and extends between the first deck edge and the second deck edge. The deck itself is not necessarily pre-stressed.

In one aspect of the invention, metal hardware embedments are cast into the surface of the concrete module to facilitate the attachment of levitation components to the concrete module. Each embedment can then be accurately machined after the concrete has fully cured, to ensure accurate positioning and alignment of the levitation components. Importantly, this can be done in spite of any concrete shrinkage and distortion that may occur during concrete curing. For example, as an alternative to the monolithically cast concrete transverse deck described above, metal overhangs can be attached to the pre-stressed box beam for the same purpose.

In a particular embodiment, the guideway modules are configured for use in a MAGLEV system which uses both an LSM and an EDS system to levitate, propel and laterally stabilize a MAGLEV vehicle over and along the guideway. For this embodiment, the module includes a mounting system for attaching LSM windings and LSM iron laminations to each concrete cantilever (or, alternatively, metal overhangs attached to the box beam). For the cantilevers, the LSM components are typically mounted on a respective cantilever surface that is located opposite the deck surface (e.g. underneath the deck surface).

In addition, the beam can be formed with two notches for use in mounting a pair of substantially flat, EDS conductive tracks to the beam. Each notch is sized to receive a portion of a respective EDS conductive track and a clamp assembly is provided to maintain the track in the notch and secure the track to the beam. Each notch extends from the first module end to the second module end and is positioned and aligned on the module to orient a respective EDS conductive track substantially parallel to the deck surface of the module. More specifically, the notches are located on opposite sides of the beam. With this cooperation of structure, the two EDS conductive sheets extend from the beam in opposite directions and in a common plane. As an alternative to notches formed in the concrete beam, the embedments described above can be used to attach the EDS conductive track to the beam.

A method for manufacturing a guideway module in accordance with the present invention includes the step of providing a steel form molding system for shaping the guideway module. In detail, the molding system has a beam portion and, optionally, a deck portion. Next, a plurality of cambered or straight pre-stressing cables are placed in the form of the molding system and are aligned to be substantially parallel to the beam's intended longitudinal axis. Once the cables are positioned in the form, they are then anchored at one end and pulled from the other end to provide the needed axial tension. With the cables in tension, the lightweight concrete is poured into the beam portion of the form and allowed to cure. The tension on the cables is then released, resulting in a precast, pre-stressed beam. After the beam has been cast, lightweight concrete can then be poured into the deck portion of the steel form and bonded with the beam. The result is a precast pre-stressed deck and beam structure that is ready for installation of the MAGLEV components after approximately 28 days of curing. Unlike a guideway that is entirely constructed at a guideway site, the use of a shop-assembled precast, pre-stressed lightweight concrete module allows for dimensional tolerances to be effectively controlled.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
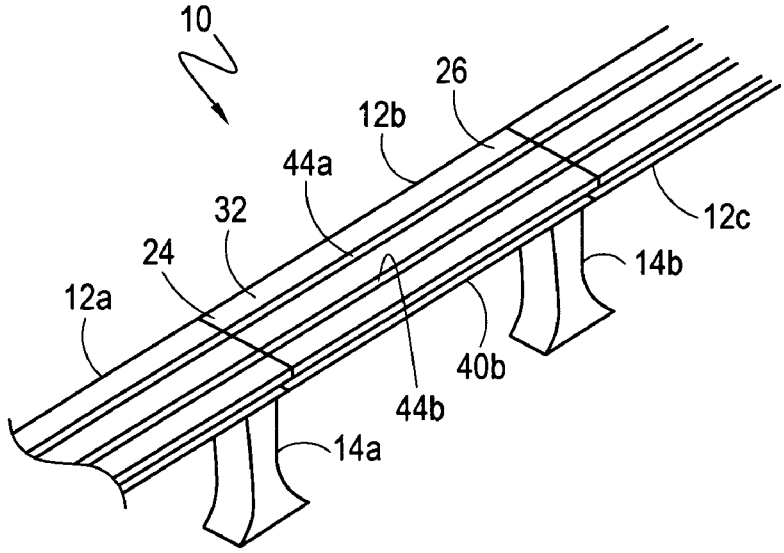
FIG. 1 is a perspective view of an elevated, modular guideway for a MAGLEV system.
Figure 2:
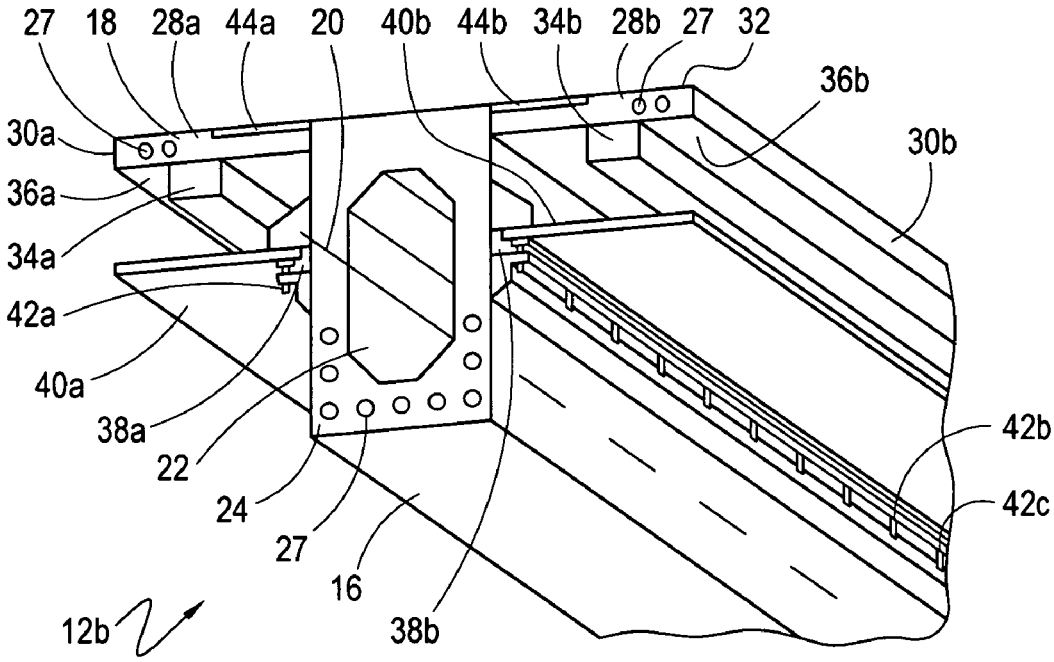
FIG. 2 is a perspective, end view of a portion of a MAGLEV guideway module with guideway-mounted LSM components shown schematically for clarity.

Referring initially to FIG. 1, an elevated, modular guideway for a MAGLEV system is shown and generally designated 10. As shown in FIG. 1, the guideway 10 includes a plurality of guideway modules 12*a-c*, with guideway module 12*b* being supported by adjacent vertical columns 14*a,b* to create a section of an elevated MAGLEV guideway 10. The guideway 10 and its components depicted in FIGS. 1 and 2 are configured for use in a MAGLEV system which uses both an LSM and an EDS system to levitate, propel and laterally stabilize a MAGLEV vehicle (not shown) over and along the guideway 10. A more detailed description of the electromagnetic interaction between the guideway-mounted EDS and LSM components and the vehicle-mounted EDS and LSM components is disclosed in co-pending, co-owned U.S. patent application Ser. No. 10/330,733 which was filed on Dec. 27, 2002 and is titled "Magnetic Levitation and Propulsion System."

Referring now to FIG. 2, it can be seen that the guideway module 12*b* includes a beam 16 and a deck 18. For the module 12*b*, the beam 16 is a so-called "box beam" that is hollow, elongated, and defines a longitudinal axis 20 in the direction of elongation. In greater structural detail, the hollow beam 16 shown is formed with a channel 22 that extends from the first end 24 of the module 12*b* to the second end 26 (see FIG. 1) of the module 12*b*. As shown in FIG. 1, the first end 24 is attached to vertical column 14*a* and mated there with adjacent module 12*a*. On the other hand, the second end 26 of module 12*b* is attached to vertical column 14*b* and mated with module 12*c*.

For the guideway 10, a portion (e.g. a lower portion) or all of the beam 16 for each levitation module 12*a-c* is made of a molded, pre-stressed concrete. FIG. 2 shows the cables 27 used to pre-stress a lower portion of the beam 16 and the extremities of the deck 18. Specifically, each beam 16 is pre-stressed in a direction that is substantially parallel to the beam's longitudinal axis 20. As revealed by FIG. 2, the module 12*b* includes a molded-concrete transverse deck 18 that is integrally formed on the hollow beam 16. Structurally, the deck 18 includes cantilevers 28*a,b*. As shown, the cantilevers 28*a,b* each extend from the beam 16, with cantilever 28*a* extending in an opposite direction from cantilever 28*b*. Moreover, FIG. 2 shows that cantilever 28*a* extends from the beam 16 to a first deck edge 30*a* and cantilever 28*b* extends from the beam 16 to a second deck edge 30*b*. Together, the cantilevers 28*a,b* and beam 16 establish a substantially flat deck surface 32 that runs from the first end 24 to the second end 26 of the module 12*b* and extends between the first deck edge 30*a* and the second deck edge 30*b*. For the guideway module 12*b*, the deck 18 is typically made of a reinforced, lightweight concrete material (which, in some cases, is pre-stressed) that is monolithically cast with the pre-stressed concrete box beam 16.

For the guideway 10, FIG. 2 shows that LSM components 34*a,b* (e.g. LSM windings and LSM iron laminations) are mounted to a respective cantilever 28*a,b* on a respective, flat cantilever surface 36*a,b* that is located opposite the deck surface 32 and oriented generally parallel thereto. Typically, these LSM components 34*a,b* extend the length of the module 12*b* and cooperate with similarly positioned components on modules 12*a* and 12*c* (see FIG. 1) to create continuous LSM components 34*a,b* that extend the length of the guideway 10.

Also shown in FIG. 2, the beam 16 is formed with two notches 38*a,b* for use in mounting a pair of substantially flat, EDS conductive tracks 40*a,b* to the beam 16. FIG. 2 illustrates that each notch 38*a,b* extends from the first end 24 to the second end 26 of the module 12*b* and is sized to receive a portion of a respective EDS conductive track 40*a,b*. Clamp assemblies which include threaded elements (of which exemplary threaded elements 42*a-c* have been labeled) are provided to maintain each track 40*a,b* in a respective notch 38*a,b* and secure each track 40*a,b* to the beam 16 of the module 12*b*. As further shown, each notch 38*a,b* and clamp assembly is positioned and aligned on the module 12*b* to orient a respective EDS conductive track 40*a,b* substantially parallel to the deck surface 32.

Cross-referencing FIG. 1 with FIG. 2, it can be seen that a pair of longitudinally aligned, elongated ferromagnetic strips 44*a,b*, which are typically made of iron, are partially embedded in the deck 18. More specifically, each ferromagnetic strip 44*a,b* has been inlayed in the deck 18 during molding of the deck 18 and includes an inlay surface that is positioned to be flush with and parallel to the surface 32 of the deck 18. For the guideway 10, these ferromagnetic strips 44*a,b* are provided to interface with a vehicle-mounted backup emergency and parking brake system (not shown).

Figure 3:
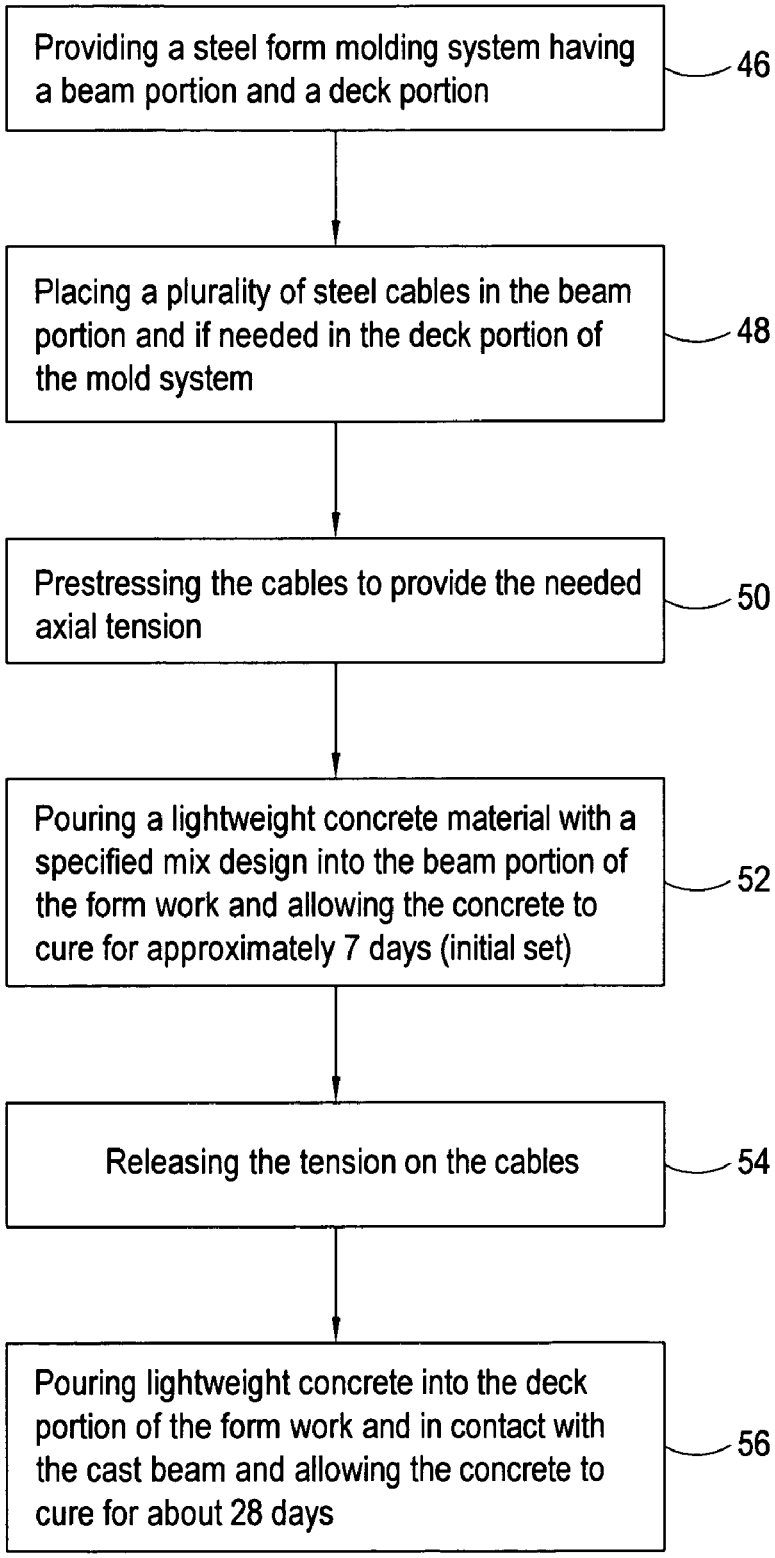
FIG. 3 is a flow chart showing the process steps for manufacturing a module for a MAGLEV guideway.

FIG. 3 illustrates method steps for manufacturing a guideway module, such as the guideway module 12*b* shown in FIGS. 1 and 2. As FIG. 3 indicates, the method includes the step of providing a steel form molding system having a beam portion and a deck portion (see box 46). Next, according to FIG. 3, a plurality of steel cables are placed in the beam portion of the mold system with each cable aligned substantially parallel to the beam's longitudinal axis (see box 48). As indicated by box 50 of FIG. 3, once the cables have been positioned in the mold, each cable is then placed in axial tension. With the cables in the mold and loaded, box 52 of FIG. 3 shows that a lightweight concrete material is introduced into the beam portion of the mold system and allowed to cure. Next, box 54 indicates that the tension on the cables is released. At this point in the process, a pre-stressed beam that consists of concrete and steel cables has been created. After the beam has been cast, lightweight concrete is poured into the deck portion of the mold system for contact with and bonding to the molded beam (see box 56). The result is a deck and beam structure that is formed as a single unitary concrete piece.

Figure 4:
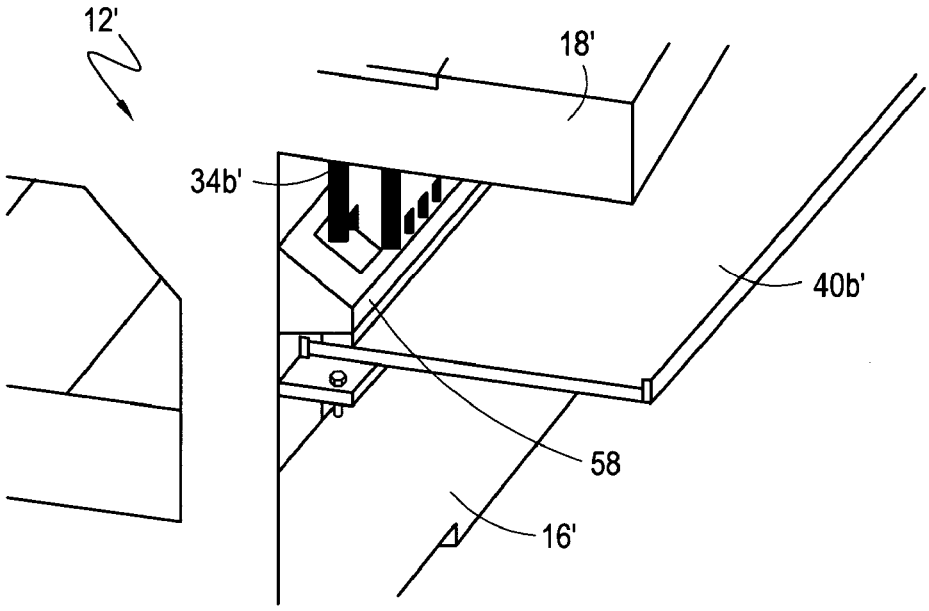
FIG. 4 is a perspective view of another embodiment of a MAGLEV guideway module which employs a metal, upper clamp member for attaching an EDS track to the concrete box beam.
Figure 5:
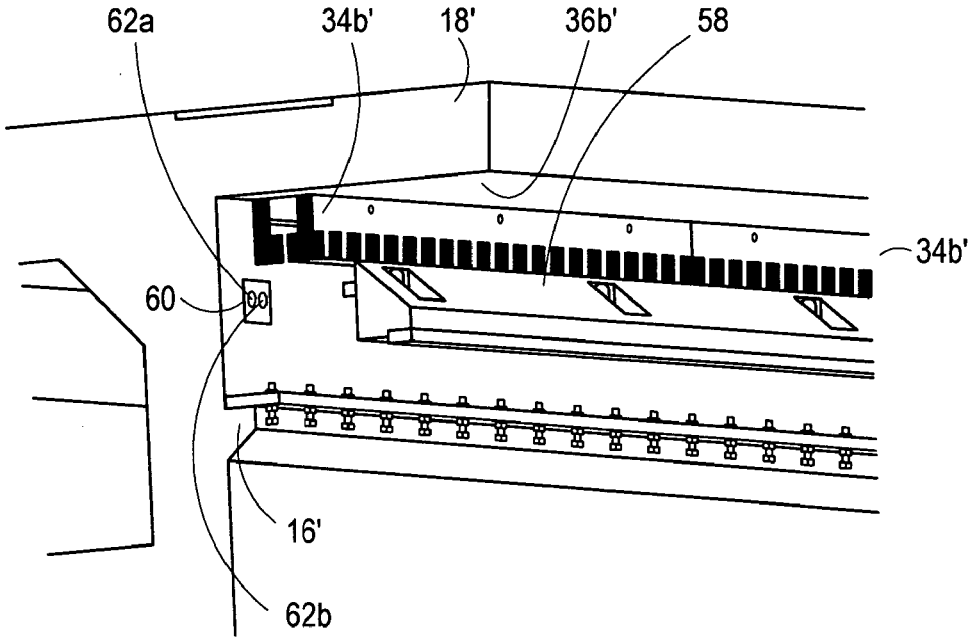
FIG. 5 is a perspective, partially exploded view of the embodiment depicted in FIG. 4 shown with the upper clamp assembly positioned to reveal a hardware embedment that is cast in the concrete box beam for accurately attaching the upper clamp assembly to the beam.

FIGS. 4 and 5 show another embodiment of a MAGLEV guideway module (generally designated 12') which employs a metal, upper clamp member 58 to attach an EDS track 40*b*' to the concrete box beam 16'. FIG. 5 shows that a hardware embedment 60 that is inlayed in the cast, concrete box beam 16' is used to accurately attach the upper clamp member 58 to the beam 16'. As shown, holes 62*a,b* are formed in the embedment 60. Specifically, these holes 62*a,b* can be machined after the concrete beam 16' has fully cured to ensure that the holes 62*a,b* are properly aligned. In addition, the flat mating surface of the embedment 60 can be machined, if necessary. With this process, adverse effects on the alignment of the EDS track 40, due to shrinkage and other fabrication factors during the casting of the deck 18' and beam 16', are greatly reduced or eliminated. Typically, holes 62*a,b* are machined to provide a shear pin hole and a tapped (i.e. threaded) hole. The upper clamping member 58 is then accurately installed using shear pins to carry the shear loads and bolts to carry the tension loads. In addition, the interface accuracy of the LSM components 34*b*' can be supplied through the use of embedded attachment plates in the surface 36*b*' of the concrete deck 18', which provide a surface to secondarily attach the LSM components 34*b*'. Adjustment of the LSM components 34*b*' can be derived from shimming the LSM interface tube, or match drilling the attachment holes for the LSM iron laminations in the interface tube.

Figure 6:
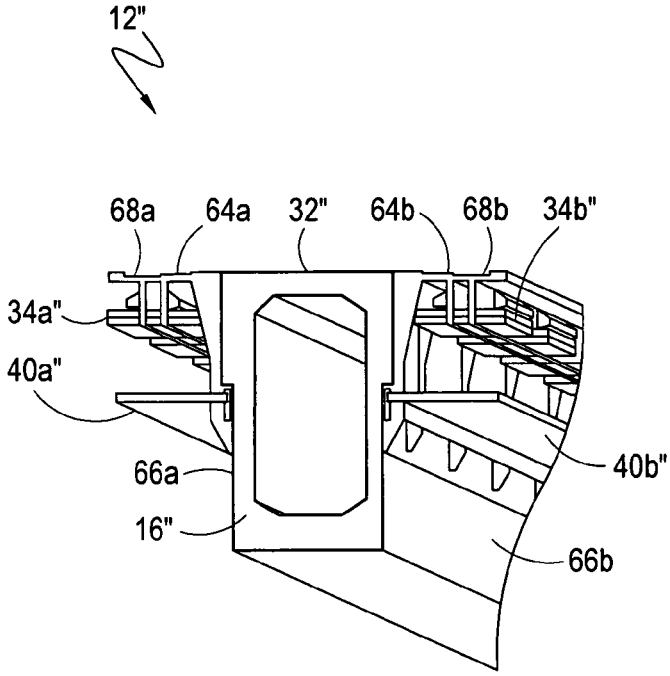
FIG. 6 shows a portion of another embodiment of a guideway module in which metal overhangs are used to attach the MAGLEV components.
Figure 7:
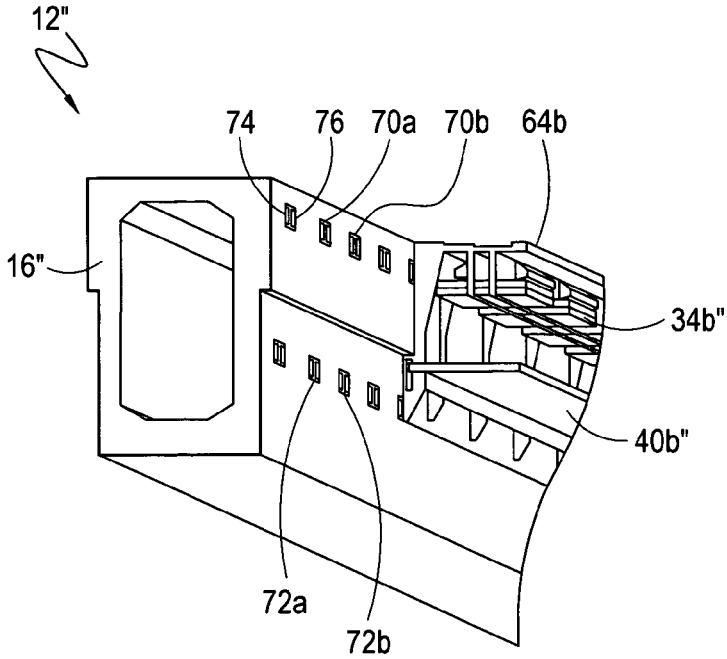
FIG. 7 shows the guideway module embodiment of FIG. 6 with a portion of an overhang removed to reveal a plurality of hardware embedments that are cast in the concrete box beam.

FIGS. 6 and 7 show yet another embodiment of a guideway module (generally designated 12") in which metal overhangs 64*a,b* are used to attach the EDS tracks 40*a*", 40*b*" and LSM components 34*a*", 34*b*". More specifically, as shown, the overhangs 64*a,b* are attached to respective side walls 66*a,b* of the box beam 16" and extend transversely therefrom. As further shown, top surfaces 68*a,b* of the overhangs 64*a,b* are positioned flush with the top surface 32" of the beam 16" to create a continuous upper deck surface along the length of the module 12".

As best seen in FIG. 7, the beam 16" is formed with a plurality of metal, upper embedments (of which upper embedments 70*a,b* are labeled) that are axially spaced along the length of the beam 16" and inlayed in the cast, concrete beam 16". In addition, the beam 16" is formed with a plurality of metal, lower embedments (of which lower embedments 72*a,b* are labeled) that are also axially spaced along the length of the beam 16" and inlayed in the cast, concrete beam 16". Embedments 70, 72 are provided to properly align and attach the overhang 64*b* to the beam 16". As shown, each embedment 70, 72 is formed with a pair of holes 74, 76 that are machinable after the concrete beam 16" has fully cured. In addition, the flat mating surface of each embedment 70, 72 can be machined, if necessary. With this process, adverse effects on the alignment of the EDS track 40*a*", 40*b*" and LSM components 34*a*", 34*b*" due to shrinkage and other fabrication factors during the casting of the beam 16" are greatly reduced or eliminated. Typically, holes 74, 76 are machined to provide a shear pin hole and a tapped (i.e. threaded) hole. The overhang 64*b* is then accurately installed using shear pins to carry the shear loads and bolts to carry the tension loads.

For the embodiments described above, the concrete used to form the beam 16, 16', 16" and deck 18, 18' can be a steel fiber reinforced concrete (SFRC). Typically, selected sections of the cast structures are pre-stressed using stressed cables 27 as described above. On the other hand, conventional metal reinforcement (i.e. rebar) is not typically necessary when the SFRC material is used. For the SFRC material, continuous micro-stitching properties of the randomly distributed steel fibers result in a significant increase in the material's flexural strength. For some test samples, a maximum ultimate flexural bending stress of approximately 23 Mpa (3,335 psi) and an ultimate minimum compressive strength of approximately 72.3 Mpa (10,480 psi) was attained. In one implementation, an SFRC material having an allowable flexural bending stress of about 10.3 Mpa (1500 psi) is used. Typically, structures cast with SFRC are strong in fatigue compression, flexural bending, ductility and impact resistance. In addition, the use of the SFRC in place of conventional reinforced concrete can significantly enhance the magnetic performance of the magnetic levitation components.

Figure 8:
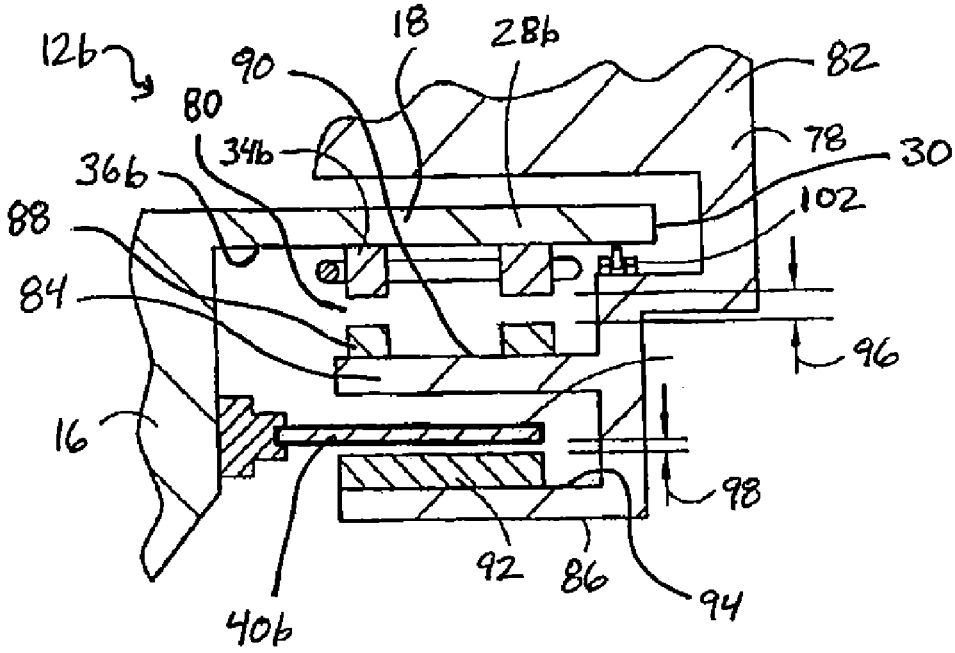
FIG. 8 is a perspective, end view of the portion of a MAGLEV guideway module of FIG. 2, shown while levitating a MAGLEV vehicle in accordance with the present invention.
Figure 9:
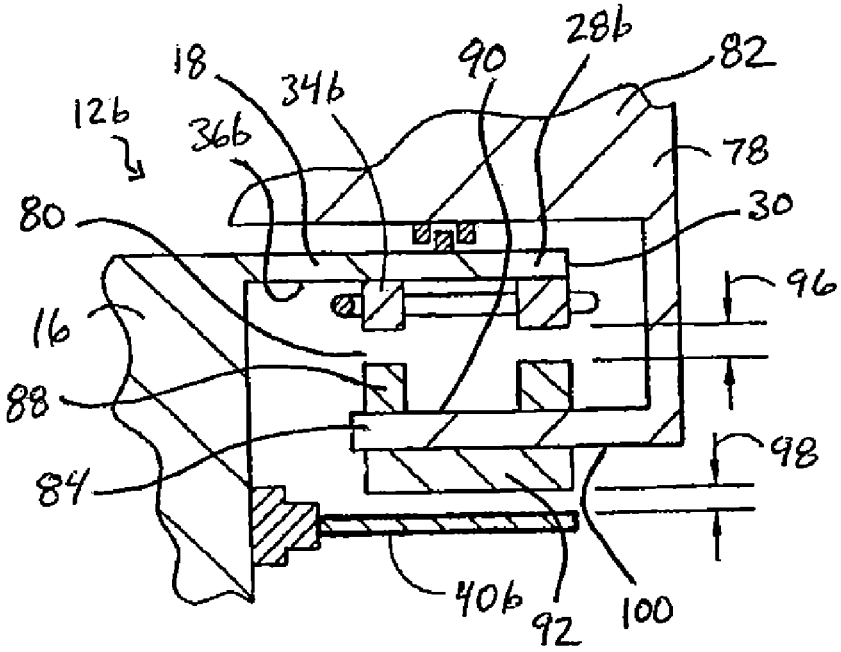
FIG. 9 a perspective, end view of the portion of a MAGLEV guideway module of FIG. 2, shown while levitating an alternate embodiment of a MAGLEV vehicle in accordance with the present invention.

Referring now to FIGS. 8 and 9, the guideway module 12*b* is shown while levitating, propelling and stabilizing a MAGLEV vehicle 78. Similar to FIG. 2, the module 12*b* in FIGS. 8 and 9 includes a beam 16 and a deck 18. Structurally, the deck 18 includes a cantilever 28*b* that extends from the beam 16 to a deck edge 30*b*. As further shown, an LSM component 34*b* is mounted to the surface 36*b* on the cantilever 28*b*. Also, an EDS conductive track 40*b* is mounted to the beam 16. As shown in FIGS. 8 and 9, the LSM component 28*b* and EDS conductive track 40*b* are distanced from one another. As a result, the module 12*b* defines a space 80 between the LSM component 34*b* and the EDS conductive track 40*b*.

Referring to FIG. 8, it can be seen that the MAGLEV vehicle 78 includes a main body portion 82. Extending from the main body portion 82 of the vehicle 78 are two shelves 84 and 86. As shown, the vehicle 78 further includes an LSM magnet array 88 provided for interaction with the LSM component 34*b* of the module 12*b*. Specifically, the LSM magnet array 88 is mounted to a surface 90 on the shelf 84. Further, the MAGLEV vehicle 78 is provided with an EDS magnet array 92 that interacts with the EDS conductive track 40*b* of the module 12*b*. As shown in FIG. 8, the EDS magnet array 92 is mounted on a surface 94 of the shelf 86.

For purposes of the present invention, the shelf 84 is received in the space 80 between the LSM component 34*b* and the EDS conductive track 40*b* of the module 12*b*. As a result, a gap width 96 between the LSM component 34*b* on the module 12*b* and the LSM magnet array 88 on the vehicle 78 is established. Further, the shelf 86 is positioned below the EDS conductive track 40*b*. As a result, a gap width 98 between the EDS track 40*b* of the module 12*b* and the EDS magnet array 92 on the vehicle 78 is established.

Functionally, electromagnetic forces between the LSM component 34*b* and the LSM magnet array 88 act to levitate and propel the vehicle 78. Importantly, the magnitudes of these electromagnetic forces are dependent on the LSM gap width 96. With this in mind, electromagnetic forces between the EDS conductive track 40*b* and the EDS magnet array 92 are used to maintain a desired LSM gap width 96. Specifically, in FIG. 8, repulsive forces between the EDS track 40*b* and the EDS magnet array 92 are created during movement of the vehicle 78. Importantly, the magnitude of the electromagnetic forces generated by the EDS track 40*b* and EDS magnet array 92 is dependent on the EDS gap width 98 and the speed of the vehicle 78.

For the present invention, a small LSM gap width 96 is maintained by the EDS track 40*b* and EDS magnet array 92 while the vehicle 78 is at low speeds. At these low speeds where acceleration is required, the vehicle 78 is most efficient when the LSM gap width 96 is small. Also, by maintaining the LSM gap width 96 within a desired width range at all vehicle speeds, instabilities of the LSM mechanism are eliminated.

With the vehicle 78 stationary and no current flowing through the LSM component 34*b*, a levitating force is provided by the attraction between the LSM magnet arrays 88 and ferromagnetic bars in the LSM component 34*b*. Preferably, the ferromagnetic bars and LSM magnet arrays 88 are sized large enough to levitate the vehicle 78 while the vehicle 18 is stationary and no current is flowing through the LSM component 34*b*. Levitation stops 102 are provided to limit the amount of levitation while the vehicle 78 is stationary and thereby establish a minimum LSM gap width 96 and EDS gap width 98. For the present invention, these stops 102 may consist of rollers, wheels or a low friction sliding surface (not shown).

When current is passed through the LSM component 34*b*, the vehicle 78 accelerates from a stationary position, and the LSM levitation force increases due to the current in the LSM component 34*b*. At the same time, movement of the vehicle 78 causes the EDS magnet array 92 to move relative to the EDS conductive track 40*b* and this movement creates a force that opposes levitation of the vehicle 78. Preferably, the EDS and LSM systems are sized so that the opposing force created by the EDS system at a predetermined vehicle speed is slightly stronger than the levitating force created by the LSM system. Accordingly, as the vehicle 78 accelerates from a stationary position, the EDS force pushes the vehicle 78 down and disengages the levitation stops 102 until an equilibrium between the LSM levitating force and the EDS opposing force is established. More specifically, the LSM and EDS systems are configured to maintain a minimum LSM gap width 96 above the predetermined vehicle 78 speed.

During constant vehicle speed and low vehicle levitation, both the LSM levitating force and the EDS opposing force are weak since both the LSM gap width 96 and EDS gap width 98 are large. On the other hand, at higher vehicle levitation, when both the LSM gap width 96 and EDS gap width 98 are small, both the LSM levitating force and the EDS opposing force are strong. Thus, the levitating and opposing forces combine to establish a fairly constant force over a range of LSM gap widths 96. By properly sizing the EDS and LSM systems, a substantially constant levitating force can be obtained that results in a stable travel for the vehicle 78. More specifically, external forces acting on the vehicle 78 from wind, aerodynamic drag, etc. that tend to reduce or increase the LSM gap width 96 will not significantly alter the levitating force, and thus, these external forces will not result in the closure of the LSM gap. It is to be appreciated that a levitation and propulsion system having an EDS and LSM system can be provided on both sides of the vehicle 78 to provide lateral stability to the vehicle 78 (in addition to providing propulsion and levitation).

In the embodiment of FIG. 8, the opposing force generated by the EDS system is weakest at low vehicle 78 speeds. Since the opposing force is weak, vehicle levitation is large and the LSM gap width 96 is small. During acceleration at low speeds, the LSM is most efficient with a small LSM gap width 96. Thus, the embodiment of the present invention shown in FIG. 8 maintains a small LSM gap width 96 at low vehicle 78 speeds and thus provides a levitation and propulsion system that is efficient during acceleration from low vehicle 78 speeds.

FIG. 9 shows another embodiment of the vehicle 78 of FIG. 8. Unlike the embodiment described in FIG. 8, in this embodiment the force generated by the EDS system acts to levitate the vehicle 78. In the embodiment shown in FIG. 9 the vehicle 78 includes only a single shelf 84 upon which the LSM magnet array 88 and EDS magnet array 92 are mounted on opposite surfaces 90 and 100. For the vehicle in FIG. 9, when the shelf 84 is received within the space 80 between the LSM components 34*b* and the EDS magnet array 92, the LSM gap width 96 and the EDS gap width 98 are established.

With this cooperation of structure, LSM gap width 96 decreases with increasing vehicle 78 levitation while the EDS gap width 98 increases with increasing vehicle 78 levitation. For the FIG. 9 embodiment, both the LSM and the EDS systems establish electromagnetic forces that act to levitate the vehicle 78 (i.e. no opposing force is created). Preferably, the LSM system is sized wherein the levitation force generated by the LSM system alone, is insufficient to levitate the vehicle 78. Also, the EDS system is sized wherein the levitation force generated by the EDS system alone, is insufficient to levitate the vehicle 78. Rather, only the combination of the levitating forces generated by the EDS and LSM system are sufficient to levitate the vehicle 78.

Once the vehicle 78 is levitated by the EDS and LSM systems, the EDS and LSM systems combine to maintain a substantially constant levitating force over a wide range of LSM gap widths 96. More specifically, consider a vehicle 78 at constant speed and relatively low levitation, the LSM gap width 96 is relatively large and the EDS gap width 98 is relatively small. Accordingly, the LSM levitating force is relatively weak and the EDS levitating force is relatively strong. On the other hand, at higher vehicle 78 levitations, the LSM gap width 96 is relatively small, the EDS gap width 98 is relatively large, and accordingly, the LSM levitating force is relatively strong and the EDS levitating force is relatively weak.

In the embodiment shown in FIG. 9, maximum LSM efficiency is obtained at high vehicle speeds (i.e. operating speeds). In greater detail, the EDS force is strongest at high vehicle 78 speeds. Since this force is repulsive between the EDS magnet array 92 and EDS conductive track 40*b*, a relatively large EDS gap width 98 occurs at high vehicle speeds. Accordingly, a relatively small LSM gap width 96 occurs at high vehicle 78 speeds. As indicated above, the LSM system is most efficient at small LSM gap widths 96. Thus, for the FIG. 9 embodiment, the LSM is most efficient at operating speed.

While the particular Modular Guideway for a Magnetic Levitation Vehicle and Method for Manufacturing a Guideway Module as herein shown and disclosed in detail are fully capable of obtaining the objects and providing the advantages herein before stated, it is to be understood that they are merely illustrative of the presently preferred embodiments of the invention and that no limitations are intended to the details of construction or design herein shown other than as described in the appended claims.

What is claimed is:

1. A method for manufacturing a module, the module for suspension between vertical columns to establish an elevated guideway for a magnetically levitated vehicle, the manufacturing method comprising the steps of:

providing a molding system, the molding system having a beam portion and a deck portion;

disposing a plurality of embedments in the beam portion;

introducing concrete into the beam portion for contact with the embedments to produce a pre-stressed elongated beam defining a longitudinal axis;

pouring concrete into the deck portion to integrally form a deck onto the pre-stressed concrete material with the deck having a first cantilever extending transversely from the beam in a first direction and a second cantilever extending transversely from the beam in a second direction, with the second direction being substantially opposite to the first direction;

mounting a means for propelling the vehicle to the first cantilever; and attaching to the embedments on the beam portion a means for positioning the vehicle relative to the propelling means, with said positioning means extending from the beam portion in the first direction, substantially parallel to the first cantilever, and with said positioning means being distanced from said propelling means to create a space therebetween for receiving a portion of the vehicle to allow said positioning means and said propelling means to control levitation of the vehicle.

2. A method as recited in claim 1 wherein the first cantilever has an underside and wherein the mounting step includes mounting the propelling means on the underside of the first cantilever.

3. A method as recited in claim 1 further comprising the steps of:

disposing a plurality of steel cables in the beam portion prior to the introducing step, each cable being aligned substantially parallel to a common axis; and placing each cable in tension prior to the introducing step.

4. A method as recited in claim 1 wherein the introducing step produces an elongated, hollow beam.

5. A method for manufacturing a module for suspension between vertical columns to establish an elevated guideway for a magnetically levitated vehicle, the manufacturing method comprising the steps of:

providing a molding system, the molding system having a beam portion;

disposing a plurality of first embedments in the molding system;

disposing a plurality of second embedments in the molding system;

introducing concrete in the beam portion for contact with the first and second embedments;

mounting a metal cantilever to at least one first embedment, said metal cantilever extending transversely from the beam portion in a first direction and having a means for propelling the vehicle connected thereto; and attaching to at least one second embedment a means for positioning the vehicle relative to the propelling means with said positioning means mounted on the beam portion and extending therefrom in the first direction, substantially parallel to the cantilever, and with said positioning means being distanced from said propelling means to create a space therebetween for receiving a portion of the vehicle to allow said positioning means and said propelling means to control levitation of the vehicle.

6. A method as recited in claim 5 further comprising the step of machining at least one embedment after the introducing step.

7. A method as recited in claim 6 wherein the machining step comprises the step of grinding a flat surface on the embedment.

8. A method as recited in claim 6 wherein the machining step comprises the step of tapping a threaded hole in the embedment.

* * * * *